United States Patent [19]

Griffith

[11] 4,040,753

[45] Aug. 9, 1977

[54] APPLICATOR INSTRUMENT

[75] Inventor: Vernon D. Griffith, Wichita, Kans.

[73] Assignee: Griffith, Inc., Wichita, Kans.

[21] Appl. No.: 705,409

[22] Filed: July 15, 1976

[51] Int. Cl.[2] ..... B43M 11/06

[52] U.S. Cl. ..... 401/186

[58] Field of Search ..... 401/183–186, 401/258, 270, 102

[56] References Cited

U.S. PATENT DOCUMENTS

| | | | |
|---|---|---|---|
| 2,994,897 | 8/1961 | Snable | 401/186 |
| 3,359,992 | 12/1967 | Cishek et al. | 401/102 |
| 3,545,874 | 12/1970 | Schwartzman | 401/186 |
| 3,655,290 | 4/1972 | Griffith | 401/186 |

*Primary Examiner*—Lawrence Charles

*Attorney, Agent, or Firm*—Schmidt, Johnson, Hovey & Williams

[57] ABSTRACT

A brush applicator instrument is provided having a compressible reservoir and valve means for selectively establishing fluid communication between the brush and the reservoir in response to compression of the reservoir. The valve means includes an extensible ferrule shiftable away from the reservoir in response to compression of the latter to thereby establish a fluid passage between the reservoir and the applicator brush such that liquid is presented to the brush only when the reservoir is compressed. An annular, flexible wall section between the reservoir and the shiftable ferrule establishes a normally sealed relationship between the reservoir and ferrule, yet due to the flexibility of the wall permits shifting movement of the ferrule relative to the reservoir when the reservoir is compressed to establish the fluid passage.

10 Claims, 4 Drawing Figures

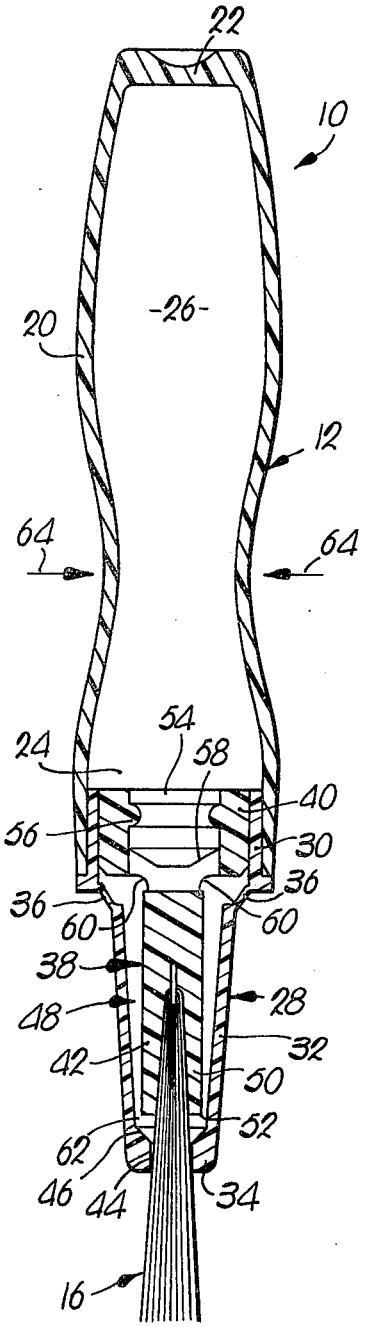
Fig. 2.
Fig. 1.
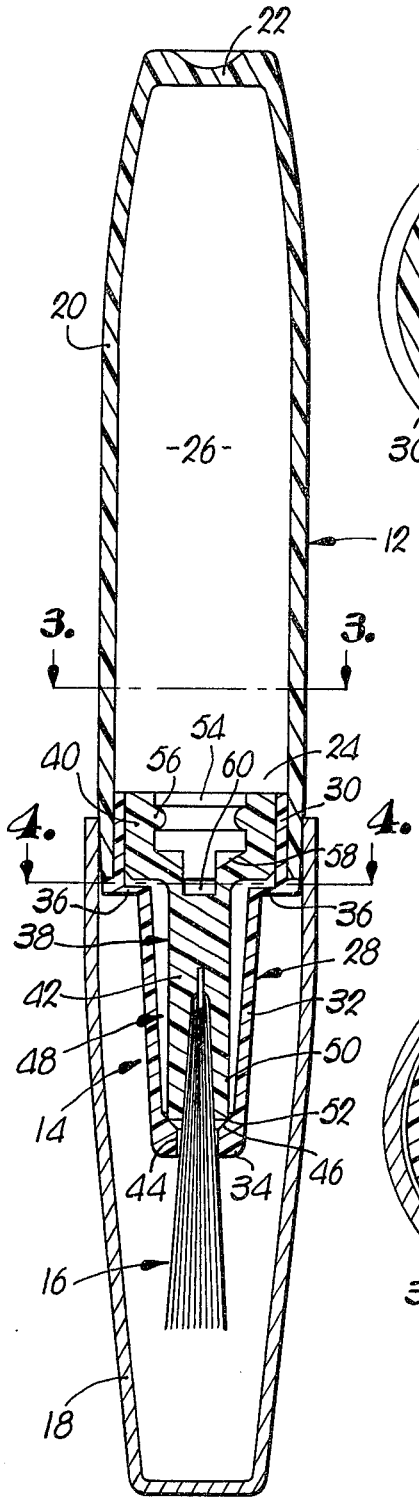
Fig. 3.
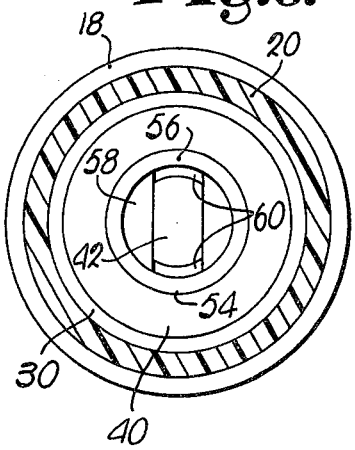
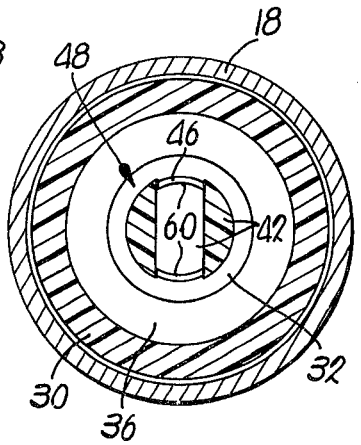
Fig. 4.

APPLICATOR INSTRUMENT

This invention relates to applicator instruments and particularly a brush applicator of the type having a self-contained reservoir associated with the applicator brush and a valve disposed between the reservoir and brush to selectively establish fluid communication between the brush and reservoir.

Brush applicators have long been used to apply various types of liquids such as fingernail enamel, glue, etc., and typically comprise a small bristle brush positioned in the cap or other closure device for the reservoir of fluid associated therewith. While these applicators present a convenience in that the brush is always readily available for use with the liquid to be applied, such applicators also present several disadvantages. For example, the brush must be continually dipped into the reservoir as liquid is applied, resulting in an accumulation of liquid adjacent the bottle neck and often causing the cap to become stuck in place on the bottle while the accumulated liquid dries. Thus, there is presented the familiar "frozen cap" problem when it is desired to remove the cap for the next use of the applicator. Another problem with conventional brush applicators is that the storage bottle is open to the atmosphere during use of the brush whereby evaporation from the bottle is permitted; this problem is particulary acute with nail enamel or other liquids having a high content of volatile solvents since evaporation of the solvents causes undesired thickening of the liquid in the bottle. Moreover, conventional brush applicators are not well suited for carrying in a purse or the like since they are susceptible to breakage and subject to leaking at the interface between the cap and bottle.

One approach to alleviating the above mentioned problem is shown in U.S. Letters Pat. No. 3,655,290, issued Apr. 11, 1972, to Vernon D. Griffith and entitled "Applicator Instrument." This patent discloses an applicator wherein the brush is permanently affixed to the reservoir in such a manner that fluid is fed from the reservoir to the top portion of the brush where it flows downwardly to the applicator end thereof. A cap member for the applicator brush cooperates with an internal mechanism in the reservoir to terminate the fluid communication between the reservoir and brush when the applicator is placed in a storage position with the cap in surrounding engagement with the applicator brush. While this device does solve some of the abovementioned problems encountered with fluid applicator devices, there still remains significant disadvantages with the use of such a device. In this connection, fluid communication between the reservoir and the applicator brush is terminated only when the cap is applied to the applicator such that fluid is at all times permitted to flow from the reservoir to the brush tip by capillary action. Consequently, there may be more fluid flowing to the brush than the operator desires at any given time and additionally, hardening of the brush occurs if the applicator is left unused for a period of time without having its storage cap positioned thereon.

Accordingly, it is an important object of the present invention to provide an applicator brush with a self-contained reservoir wherein fluid is presented to the brush only at the discretion of the brush user.

In accordance with the foregoing object, it is another important object of the present invention to provide an applicator brush with a flexible reservoir and valve means disposed between the brush and the reservoir such that fluid communication is established from the reservoir to the brush only upon compression of the flexible reservoir.

It is yet another object of the instant invention to provide an applicator brush as above with a ferrule element, and a flexible wall section extending between the ferrule element and the reservoir such that the ferrule element is shiftable away from the reservoir in response to compression of the latter.

It is a further important object of my invention to provide an applicator as above wherein the brush is mounted within a stem element rigidly secured to the reservoir in fluid communication therewith and cooperable with the ferrule element to form a fluid seal when the reservoir is in its normal compressed state, which seal is broken when the reservoir is compressed to shift the ferrule element outwardly therefrom.

In the drawing:

FIG. 1 is a central, longitudinal, cross-sectional view of the applicator shown with a flexible wall in a contracted position placing the applicator fluid valve in a seated position and with the applicator cap emplaced upon the main body of said applicator;

FIG. 2 is a central, longitudinal, cross-sectional view of the applicator instrument shown with a flexible wall in a deflected position when the compressible hollow body forming the liquid reservoir is compressed.

FIG. 3 is a cross-sectional view taken on line 3—3 of FIG. 1; and

FIG. 4 is a cross-sectional view taken on line 4—4 of FIG. 1.

In FIG. 1 there is shown an applicator instrument 10 comprising a compressible, hollow reservoir 12, a nozzle assembly 14 which supports an applicator brush 16, and a hollow, frustoconical cap 18 releasably engageable with reservoir 12 in surrounding relationship to nozzle assembly 14 and brush 16. The instrument 10 is shown in its storage position in FIG. 1 wherein cap 18 is emplaced over brush 16 to seal the latter from the atmosphere, it being understood that the instrument 10 is normally used with cap 18 removed as shown, for example, in FIG. 2.

The reservoir 12 is constructed of a resilient, yet flexible material and presents a substantially cylindrical tubular configuration having flexible sidewalls 20, an end wall 22, and an opposed open end 24. The interior of reservoir 12 defines a reservoir chamber 26 which is normally filled with liquid of the type desired to be dispensed by the instrument 10. The open end 24 of reservoir 12 is substantially enclosed by nozzle assembly 14 in a manner to be described hereinbelow.

Nozzle assembly 14 includes a elongate ferrule element 28 having an annular base 30 in sealing engagement with the sidewall 20 of reservoir 12 adjacent open end 24 and a hollow, frustoconical tip 32 having a maximum diameter which is smaller than the diameter of annular base 30 and extending from the base 30 to an outermost end 34. Base 30 and tip 32 are positioned in axial alignment with cylindrical reservoir 12, and there is an annular flexible wall 36 extending in a generally radial direction between the base 30 and the tip 32. The presence of wall 36 permits limited axial movement of tip 32 outwardly away from base 30 and end 24 in response to an increase in pressure in chamber 26 which would occur is sidewalls 20 were compressed as is shown in FIG. 2.

The outermost end 34 of tip 32 has an axially extending hole 44 formed therein to provide a passage from the inside of ferrule 28 to the atmosphere. The inner rim of hole 44 has a beveled, annular seal surface 46 for a purpose to be described hereinbelow.

Nozzle assembly 14 also includes a stem element 38 disposed substantially within ferrule element 28 and having a generally cylindrical base 40 in sealing engagement with ferrule base 30, and an elongate, cylindrical support member 42, somewhat smaller in diameter than base 40 and constructed to fit loosely within tip 32, to define an annular passage 48 between member 42 and tip 32 extending from base 40 to surface 46. The member 42 has an outermost end 50 including an annular edge 52 which normally engages surface 46, as shown in FIG. 1, to form a tight fluid seal with that surface.

The base 40 has a generally cylindrical, axially extending cavity 54 extending from the surface of base 40 which is immediately adjacent chamber 26. Cavity 54 has an annular rib 56 positioned approximately midlength of the cavity and further includes a tapered bottom 58. A pair of fluid ports 60 extend from the bottom 58 to passage 48 such that fluid communication is established between chamber 26 and passage 48 via cavity 54 and ports 60.

At this point it is important to understand that the above described fluid seal between edge 52 of stem element 38 and surface 46 of ferrule element 28, may be selectively broken by compressing the sidewalls 20 of reservoir 12 as shown, for example, in FIG. 2. When the seal is broken, there is established a fluid passage 62 between passage 48 and hole 44 such that chamber 26 is placed in fluid communication with the atmosphere. However, it should be understood that passage 62 exists only when the pressure in chamber 27 is sufficient to cause axial movement of tip 32 as shown in FIG. 2. This increase in pressure is preferably effected by the operator compressing sidewalls 20 to exert a manual force represented by arrows 64 as shown in FIG. 2.

The brush 16 is of conventional construction, comprising a plurality of bristles constructed from any suitable material such as nylon or the like and is rigidly secured to support member 42 in general axial alignment with reservoir 12 and ferrule 28. The brush extends outwardly from support member 42 and is of such a length that it projects outwardly through hole 44 in outermost end 34 of ferrule element 28. In this manner the brush receives any fluid which passes from chamber 26 through selectively established passage 62 and axially extending hole 44.

The operation of the present invention should be apparent from the foregoing description of the preferred embodiment. The instrument 10 is normally stored with its cap 18 positioned as shown in FIG. 1, and a quality of liquid contained within the reservoir chamber 26. When it is desired to use the instrument 10 to apply liquid contained within chamber 26, the operator first removes the cap 18 to expose nozzle assembly 14 and brush 16.

A few gentle squeezes by the operator on sidewalls 20 of reservoir 12 will cause the fluid in chamber 26 to be forced through cavity 54, ports 60, passage 48 to the seal between edge 52 and surface 46. Since the instrument 10 is normally used in an upright position, this flow will be enhanced by the effect of gravity.

The operator then simply exerts a force on sidewalls 20 sufficient to cause tip 32 to shift outwardly from reservoir 12 such that passage 62 is established between passage 48 and hole 44 whereupon fluid will be permitted to flow from passage 48 to brush 16 for application in a desired manner. When the operator determines that there is sufficient fluid on the brush 16 for immediate application, he releases the force on sidewalls 20 such that the seal between edge 52 and surface 46 is reestablished and no fluid is permitted to flow to the brush 16. The operator then is free to apply the amount of liquid on brush 16 in any suitable manner. As the amount of liquid on brush 16 is required to be periodically replenished, the operator merely reapplies manual pressure to sidewalls 20 to effect additional flow of liquid from chamber 26 to the brush 16.

Should the operator desire to discontinue use of the brush for a short period of time he may simply place the brush in a safe location, confident that no additional fluid will flow from chamber 26 to the brush 16 during his absence. Of course, should the operator discontinue use of the brush for an extended period of time he would replace cap 18 to assure that the brush was protected during storage.

Thus, the present invention provides a simple yet extremely effective brush applicator wherein liquid flow to the brush is established only at the direction of the operator. In this manner, the proper amount of liquid may be supplied to the brush at all times, there being little probablity of excess liquid being presented to the brush during use of the applicator. Moreover, the positive seal between edge 52 of stem element 38 and surface 46 of the ferrule element 28 assures that no fluid flows to the brush by capillary action during storage or periods of nonuse.

Additionally, all of the above-mentioned desirable features are accomplished without the use of springs, sliding parts, or other complicated mechanisms since the required movement of tip 32 is effected solely by flexible wall 36 in response to pressure changes in chamber 26.

Having thus described the invention, what is claimed as new and desired to be secured by Letters Patent is:

1. A liquid applicator instrument comprising:

a compressible hollow body adapted to contain said liquid and having an open end;

a nozzle assembly mounted in the open end of the body and including a stem element and a ferrule element, said ferrule element having a base retained within the open end of the hollow body, and a tip extending outwardly from the base;

liquid passage means through the nozzle, said passage means being open when said elements are in one relative position and closed when said elements are in another relative position; and brush means mounted in the nozzle assembly and disposed to receive liquid from the passage means when the latter is open, said ferrule element including a flexible wall interconnecting the base and the tip of said ferrule, whereby said tip may be shifted to said one relative position with respect to said stem upon compression of said hollow body to open said passage and to said other relative position upon release of such compression to close said passage

2. The invention of claim 1, wherein is provided cap means removably mountable on said hollow body in covering relationship to said nozzle assembly.

3. The invention of claim 1, wherein said hollow body is generally tubular, is constructed of yieldable material, and is manually compressible for forcing liquid from the interior of said body through said passage means and onto said brush means.

4. The invention of claim 1, wherein said flexible wall retains said ferrule element in sealing engagement with said stem element to close said liquid passage means when said hollow body is not sufficiently compressed to deflect said flexible wall.

5. The invention of claim 1, wherein said liquid passage means includes a chamber between said ferrule and stem elements, an opening through said stem element communicating said chamber with the interior of said hollow body, and a bore through said ferrule element communicating said chamber with the exterior of the instrument when said hollow body is compressed and the flexible wall is thereby deflected.

6. The invention of claim 5, wherein said brush means is mounted on said stem element and extends outwardly through said bore.

7. The invention of claim 5, wherein said stem element includes a base seated in the base of said ferrule element and an elongated support member attached to said base and extending outwardly therefrom within the confines of the tip of the ferrule element.

8. The invention of claim 7, the interior of the tip of the ferrule element presenting a seal surface in surrounding relationship to the base, the outermost end of said support member being in spaced relationship from said surface and when the elements are in said one relative position and in engagement with said surface when the elements are in said other relative position.

9. The invention of claim 8, wherein said outermost end of said support member is unseated in said one relative position to said seal surface in said tip of the ferrule element when liquid pressure in said passage means reaches a magnitude sufficient to exert a force upon said tip of said ferrule element causing said flexible wall to deflect.

10. The invention of claim 8, wherein the outermost end of said support member is seated in said other relative position to the seal surface in said tip of said ferrule element when said flexible wall is in an undeflected position, and whereby liquid flow through said passage means onto said brush means in prevented.

* * * * *